US009442411B2

(12) United States Patent
Kato

(10) Patent No.: US 9,442,411 B2
(45) Date of Patent: Sep. 13, 2016

(54) IMAGE FORMING APPARATUS

(71) Applicant: CANON KABUSHIKI KAISHA, Tokyo (JP)

(72) Inventor: Hirohisa Kato, Tsukubamirai (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/523,609

(22) Filed: Oct. 24, 2014

(65) Prior Publication Data

US 2015/0130884 A1 May 14, 2015

(30) Foreign Application Priority Data

Nov. 8, 2013 (JP) ..... 2013-231840

(51) Int. Cl.
*G03G 15/043* (2006.01)

(52) U.S. Cl.
CPC ..... *G03G 15/043* (2013.01)

(58) Field of Classification Search
CPC ..... B41J 2/44; B41J 3/00; G03G 15/04; G03G 15/043
See application file for complete search history.

(56) References Cited

U.S. PATENT DOCUMENTS

2011/0243590 A1* 10/2011 Ito ..... G03G 15/0409 399/51
2013/0016169 A1* 1/2013 Ohtoshi ..... G03G 15/04045 347/116

FOREIGN PATENT DOCUMENTS

JP H07-36600 4/1995

* cited by examiner

*Primary Examiner* — Sarah Al Hashimi
(74) *Attorney, Agent, or Firm* — Fitzpatrick, Cella, Harper & Scinto

(57) ABSTRACT

An image forming apparatus, including: a photosensitive member; a light source configured to emit a light beam; a deflecting unit configured to deflect the light beam to scan the photosensitive member to form an electrostatic latent image and having a rotary polygon mirror and a motor configured to rotate the rotary polygon mirror; a housing provided with the photosensitive member, the light source, and the deflecting unit; a temperature detecting unit configured to detect a temperature; and a control unit configured to pre-rotate the rotary polygon mirror before a start signal for image formation and to rotate, after the start signal, the rotary polygon mirror at a rotation speed higher than a rotation speed for pre-rotation of the rotary polygon mirror, wherein the control unit sets a target value of the rotation speed for the pre-rotation based on a result of detection by the temperature detecting unit.

14 Claims, 11 Drawing Sheets

IMAGE FORMING APPARATUS

BACKGROUND OF THE INVENTION

1. Field of the Invention

The present invention relates to an image forming apparatus including a motor configured to rotate a rotary polygon mirror.

2. Description of the Related Art

In an image forming apparatus such as a copying machine or a printer, as a unit configured to form an electrostatic latent image on a photosensitive member, there is hitherto widely used a light scanning apparatus for scanning the photosensitive member with a light beam which is emitted from a semiconductor laser and deflected by a rotary polygon mirror.

It is known that a rotary polygon mirror driving motor (hereinafter simply referred to as a motor) configured to rotate a rotary polygon mirror has large inertia and takes a long period of time until a rotation speed thereof is stabilized. Further, along with the recent increase in operation speed of the image forming apparatus, it becomes more necessary to rotate the motor at extremely high speed when an image is formed, and thus, a rise time necessary for the motor to reach a main rotation speed when an image is formed from a stopped state becomes longer. Further, high speed rotation of the rotary polygon mirror presents a noise problem due to wind noise and a problem in which a life-time of the motor is shortened.

An image forming apparatus starts image formation in a state in which the rotation speed of the motor is stabilized. Therefore, generally, a first copy output time, that is, a time period necessary from when a copy start button is pressed down until a first paper sheet is output is affected by the rise time of the motor.

Japanese Patent Publication No. H07-36600 discloses that, when image data is transferred to a control device, the motor is rotated at a preliminary rotation speed which is lower than the main rotation speed of a time of image formation, and when a form feed signal is sent to the control device, the motor is rotated at the main rotation speed.

FIGS. 9A, 9B, and 9C are graphs showing characteristics of the motor. FIG. 9A shows a relationship between time and a rotation speed of the conventional motor. FIG. 9B shows a relationship between an ambient temperature of the motor and the rise time of the motor. FIG. 9C shows a relationship between a total operation time of the motor and the rise time of the motor.

In Japanese Patent Publication No. H07-36600, as shown in FIG. 9A, when the image data is transferred to the control device (hereinafter referred to as a pre-operation), rotation of the motor is started, and the motor is rotated at the preliminary rotation speed. When a receipt of a form feed signal (hereinafter referred to as a predetermined operation) is performed, the control device increases the rotation speed of the motor to rotate the motor at the main rotation speed for image formation. In this way, the rotation speed of the motor is controlled to be a single predetermined preliminary rotation speed during a pre-operation period from the pre-operation to the predetermined operation.

On the other hand, as can be understood from characteristics of the motor shown in FIG. 9B, the rise time of the motor from the stopped state of the motor till when the motor reaches the main rotation speed of 48,000 rpm is longer when the ambient temperature of the motor is low than when high. Further, as shown in FIG. 9C, the rise time of the motor is longer when the total operation time is long than when short.

The motor is required to become rotated with stability at the main rotation speed for image formation before latent image formation is started. Therefore, the preliminary rotation speed is set with reference to a case where the rise time of the motor is long, so that the motor becomes rotated with stability at the main rotation speed before the latent image formation is started. It follows that, when the rise time of the motor is short, the motor is rotated at the preliminary rotation speed for a time period longer than necessary, which reduces an effect of reducing noise during the pre-operation period and an effect of increasing a life-time of the motor.

SUMMARY OF THE INVENTION

Accordingly, the present invention provides an image forming apparatus which can reduce noise of a motor and increase a life-time of the motor without increasing a time period from when a start signal for instructing start of image formation is generated to when electrostatic latent image formation is started.

In order to solve the problem described above, an image forming apparatus according to one embodiment of the present invention comprises: a photosensitive member; a light source configured to emit a light beam based on image data to form an electrostatic latent image on the photosensitive member; a deflecting unit configured to deflect the light beam so that the light beam scans the photosensitive member, the deflecting unit comprising a rotary polygon mirror and a motor configured to rotate the rotary polygon mirror; a housing provided with the photosensitive member, the light source, and the deflecting unit; a temperature detecting unit configured to detect a temperature; and a control unit configured to pre-rotate the rotary polygon mirror before a start signal for instructing a start of image formation is generated, and configured to rotate, after the start signal is generated, the rotary polygon mirror at a rotation speed which is higher than a rotation speed for pre-rotation of the rotary polygon mirror, wherein the control unit sets a target value of the rotation speed for the pre-rotation of the rotary polygon mirror based on a result of detection by the temperature detecting unit.

Further features of the present invention will become apparent from the following description of exemplary embodiments with reference to the attached drawings.

DESCRIPTION OF THE EMBODIMENTS

The embodiments will be hereinafter described with reference to the accompanying drawings.

First Embodiment (Image Forming Apparatus)

Figure 1:
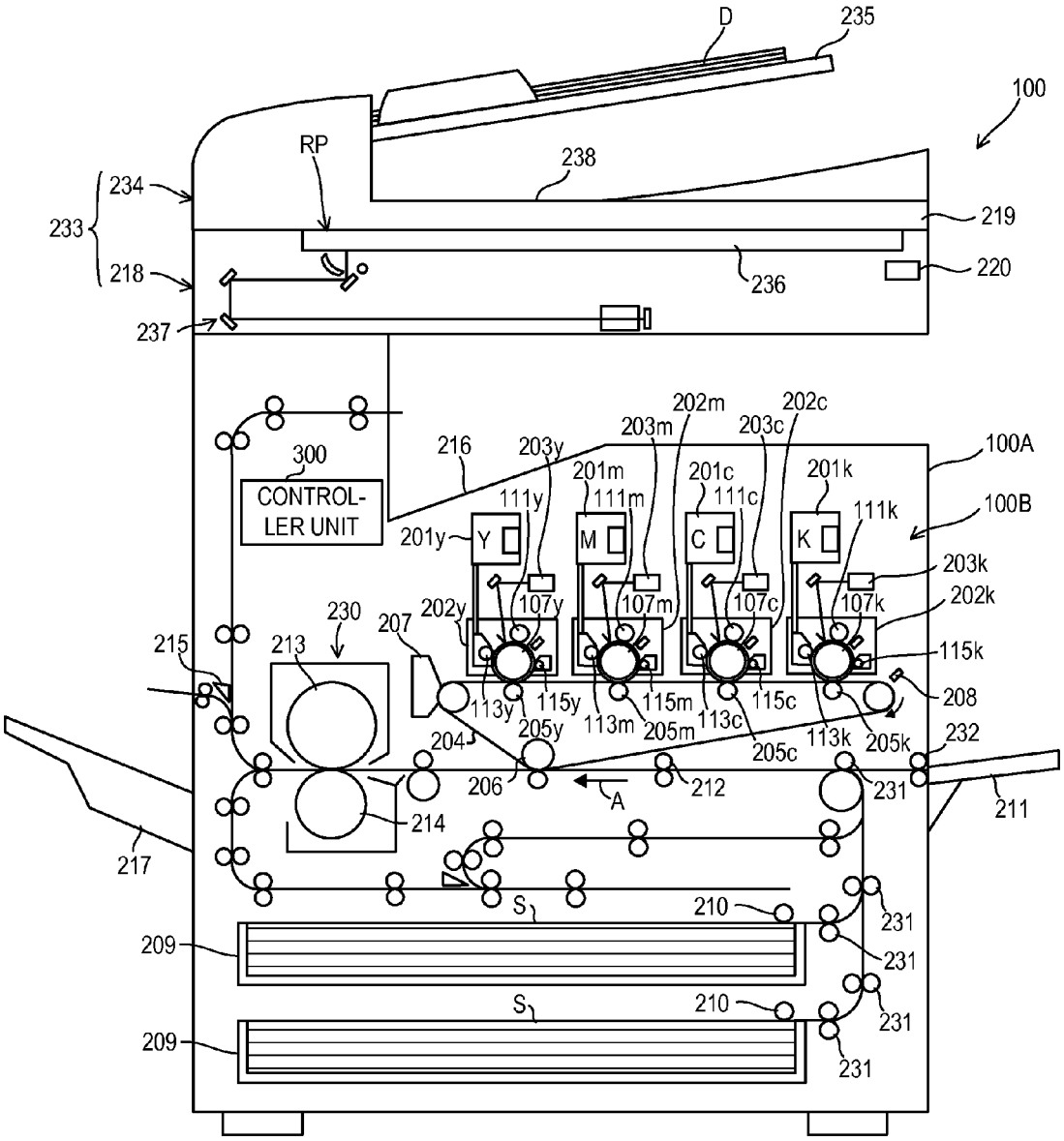
FIG. 1 is a view illustrating a structure of an image forming apparatus according to a first embodiment.

FIG. 1 is a view illustrating a structure of an image forming apparatus 100 according to a first embodiment.

An image forming portion 100B is provided in a main body (housing) 100A of the image forming apparatus 100. A sheet feeding cassette 209 containing a recording medium S is disposed in the bottom of the main body 100A. An intermediate transfer member (intermediate transfer belt) 204 is disposed above the sheet feeding cassette 209. Four process units 202 of yellow, magenta, cyan, and black (202*y*, 202*m*, 202*c*, and 202*k*) are disposed above the intermediate transfer member 204. A fixing device 230 including a fixing roller 213 and a pressure roller 214 is disposed on a downstream side of the intermediate transfer member 204 in a conveyance direction A of the recording medium S. An original reading apparatus 218 is disposed on the main body 100A.

The structure, together with operation, of the image forming apparatus 100 will be hereinafter described. Toner bottles (developer containers) 201 (201*y*, 201*m*, 201*c*, and 201*k*) are filled with yellow, magenta, cyan, and black toners (developers), respectively. The process units 202 each include a photosensitive drum (photosensitive member) 107, a charging roller 111, a developing unit 113, and a photosensitive drum cleaner 115.

The charging rollers 111 (111*y*, 111*m*, 111*c*, and 111*k*) uniformly charge surfaces of the photosensitive drums 107 (107*y*, 107*m*, 107*c*, and 107*k*), respectively. Light scanning apparatus (laser scanner units) 203 (203*y*, 203*m*, 203*c*, and 203*k*) radiate laser light (hereinafter referred to as light beams) onto the surfaces of the uniformly charged photosensitive drums 107 in accordance with image information, to thereby form electrostatic latent images, respectively. The electrostatic latent images are developed into toner images of the respective colors by the developing units 113 (113*y*, 113*m*, 113*c*, and 113*k*), respectively.

A bias voltage is applied to primary transfer rollers 205 (205*y*, 205*m*, 205*c*, and 205*k*), and the toner images on the photosensitive drums 107 are primarily transferred in sequence onto the intermediate transfer member 204 by the primary transfer rollers 205, and the toner images are superimposed on top of each other on the intermediate transfer member 204.

Toners which remain on the photosensitive drums 107 after the primary transfer are collected by the photosensitive drum cleaners 115, respectively. A reflected light amount sensor 208 irradiates the toner images on the intermediate transfer member 204 with light, and receives reflected light to detect densities of the toner images.

On the other hand, the recording medium S is fed from the sheet feeding cassette 209 by feed rollers 210, and is conveyed to registration rollers 212 by conveyance rollers 231. Alternatively, the recording medium S is fed from a manual feed tray 211 by feed rollers 232 and is conveyed to the registration rollers 212 by the conveyance rollers 231. The registration rollers 212 corrects skew feeding of the recording medium S, and thereafter conveys the recording medium S to a secondary transfer roller 206 in timing with the toner images on the intermediate transfer member 204.

The toner images in the four colors which are superimposed on the intermediate transfer member 204 are collectively secondarily-transferred onto the recording medium S by the secondary transfer roller 206.

Toners which remain on the intermediate transfer member 204 after the secondary transfer are collected by an intermediate transfer member cleaner 207.

The recording medium S having the toner images transferred thereon is heated and pressurized by the fixing device 230, and the toner images are fixed to the recording medium S as a color image. The recording medium S having the color image formed thereon is delivered onto an inner sheet delivery tray 216 or a sheet delivery tray 217 by a sheet deliver flapper 215.

The embodiment uses the image forming apparatus 100 which forms a color image, but the embodiment is not limited thereto, and can also be applied to an image forming apparatus which forms a monochrome image.

(Reading Apparatus)

A reading apparatus 233 includes an automatic original feeder 234 and the original reading apparatus 218. The automatic original feeder 234 conveys an original D which is placed on an original tray (second original placing portion) 235 onto a platen glass (first original placing portion) 236. The original reading apparatus 218 reads an image on the original D to generate image information.

The original reading apparatus 218 includes the platen glass 236, a reading portion (reading unit) 237 configured to read an image on the original D, and a pressure cover opening and closing detecting optical sensor 220 configured to detect an opening or closing state of an original pressure cover 219. The reading portion 237 is disposed below the platen glass 236. The original D is placed on the platen glass 236, and an image on the original D is read by the reading portion 237.

The automatic original feeder 234 includes the original pressure cover 219 which is opened or closed with respect to the platen glass 236, an original tray 235 on which the original D to be conveyed to a reading position RP at which the original D is read by the reading portion 237 is placed, and a delivery tray 238 to which the read original D is delivered.

Figure 4:
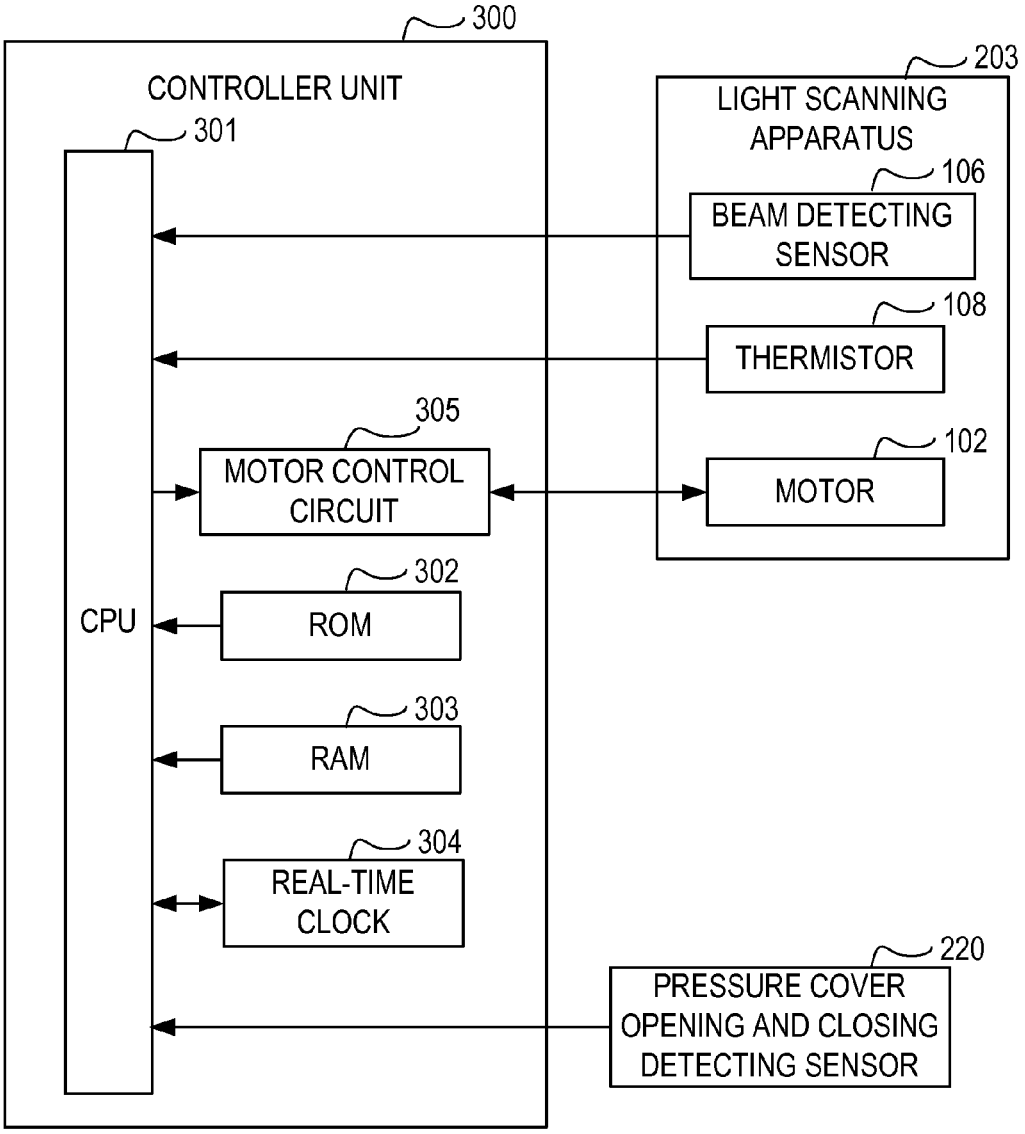
FIG. 4 is a block diagram of a controller unit.

The original reading apparatus 218 reads an image on the original D and sends image data (image signals) thereof to a controller unit 300 provided in the main body 100A. The controller unit 300 stores the image data in a RAM 303 via a CPU (control unit) 301 (FIG. 4).

The original pressure cover 219 serves as a lid configured to cover the original D placed on the platen glass 236. The CPU 301 detects an opening or closing state of the original pressure cover 219 by using the pressure cover opening and closing detecting sensor 220.

(Operating Portion)

Figure 2A:
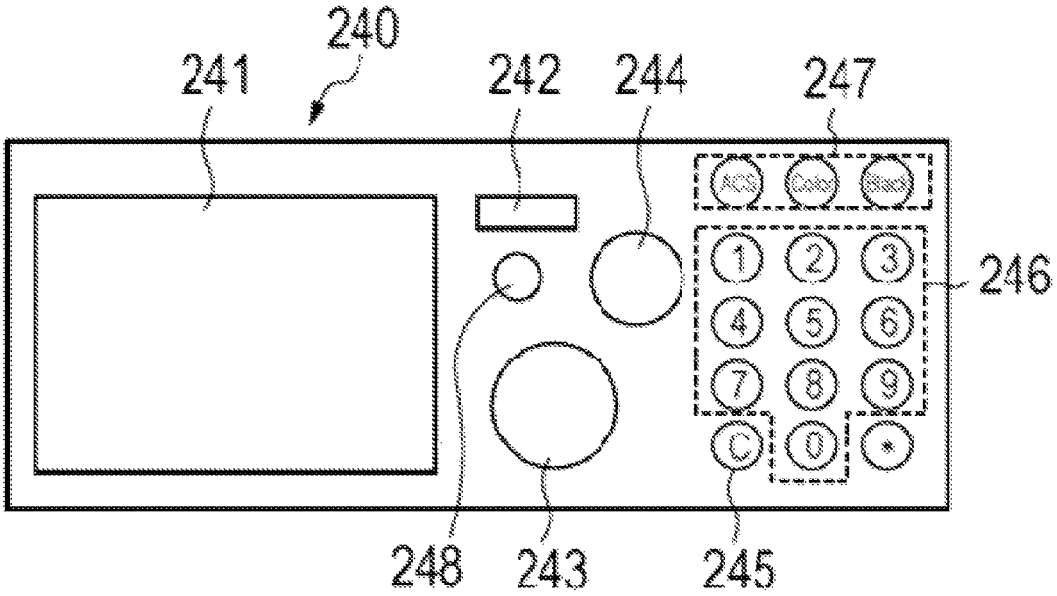
FIGS. 2A and 2B are explanatory diagrams of an operating portion.
Figure 2B:
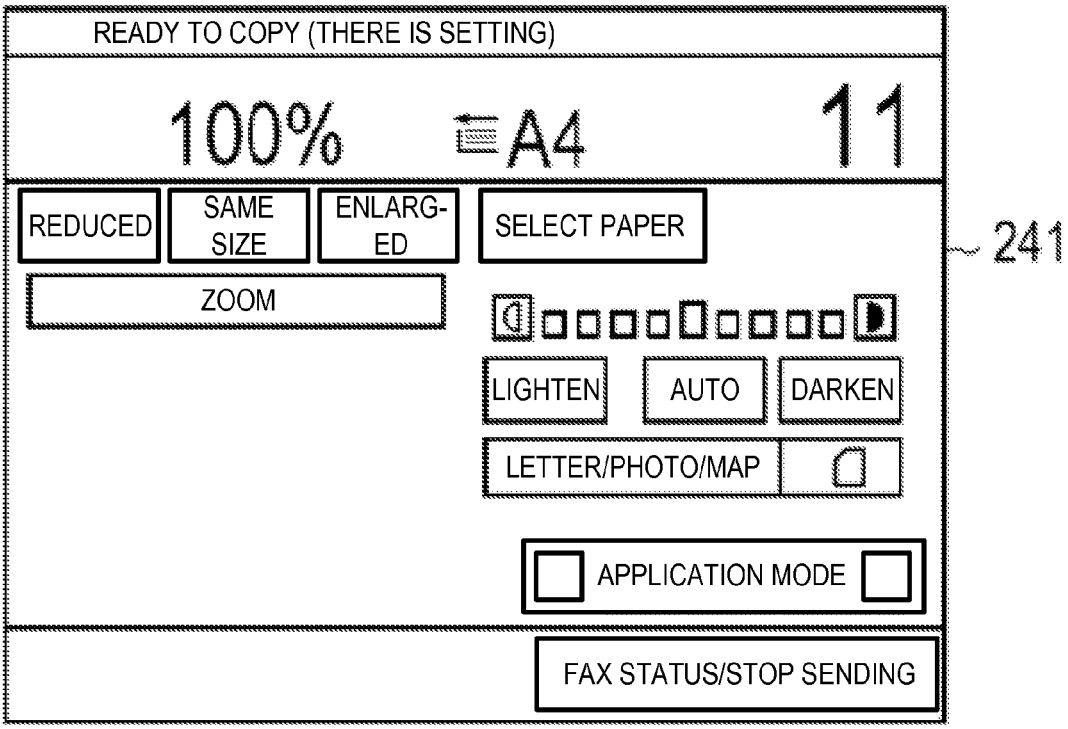

FIGS. 2A and 2B are explanatory diagrams of an operating portion 240. The operating portion 240 is provided in an upper portion of the image forming apparatus 100 (not shown in FIG. 1). FIG. 2A is a plan view of the operating portion 240 in the embodiment.

The operating portion 240 includes setting buttons 246 and 247 configured to set image formation conditions and a touch panel display (display portion) 241 configured to set image formation conditions. FIG. 2B is a view illustrating a display of the touch panel display 241. The touch panel display 241 displays the image formation conditions such as the number of copies, the selected paper size, the magnification, the copy density, the finishing, and the one-side/two-side mode. The operating portion 240 includes a reset key 242 configured to reset a copy mode to a normal mode. A START key (instruction button) 243 is used to issue a command for starting a copy operation by being pressed down, that is, generates a start signal for instructing a start of image formation. A STOP key 244 stops image formation. A CLEAR key 245 clears an input numeric value. A numeric keypad 246 sets the number of copies. A color mode selection keypad (setting buttons) 247 includes an ACS key, a Color key, and a Black key. Any one of the keys in the color mode selection keypad 247 is selected and lighted. When the ACS key is lighted, whether the original has a color image or a monochrome image is automatically determined. When the original is determined to have a color image, a color image is output, and when the original is determined to have a monochrome image, a monochrome image is output. When the Color key is lighted, a color image is output without determination of the original. When the Black key is lighted, a monochrome image is output without determination of the original.

When a user mode key 248 is pressed, a menu can be selected so that various kinds of settings and conditioning may be performed on the image forming apparatus 100.

(Light Scanning Apparatus)

The four light scanning apparatus 203*y*, 203*m*, 203*c*, and 203*k* provided in the image forming apparatus 100 have similar structures, and thus, a description will be hereinafter provided of only the light scanning apparatus 203*y*. Note that, the suffix alphabets y, m, c, and k added to reference symbols mean yellow, magenta, cyan, and black, respectively, but are omitted in the following unless otherwise deemed necessary.

Figure 3:
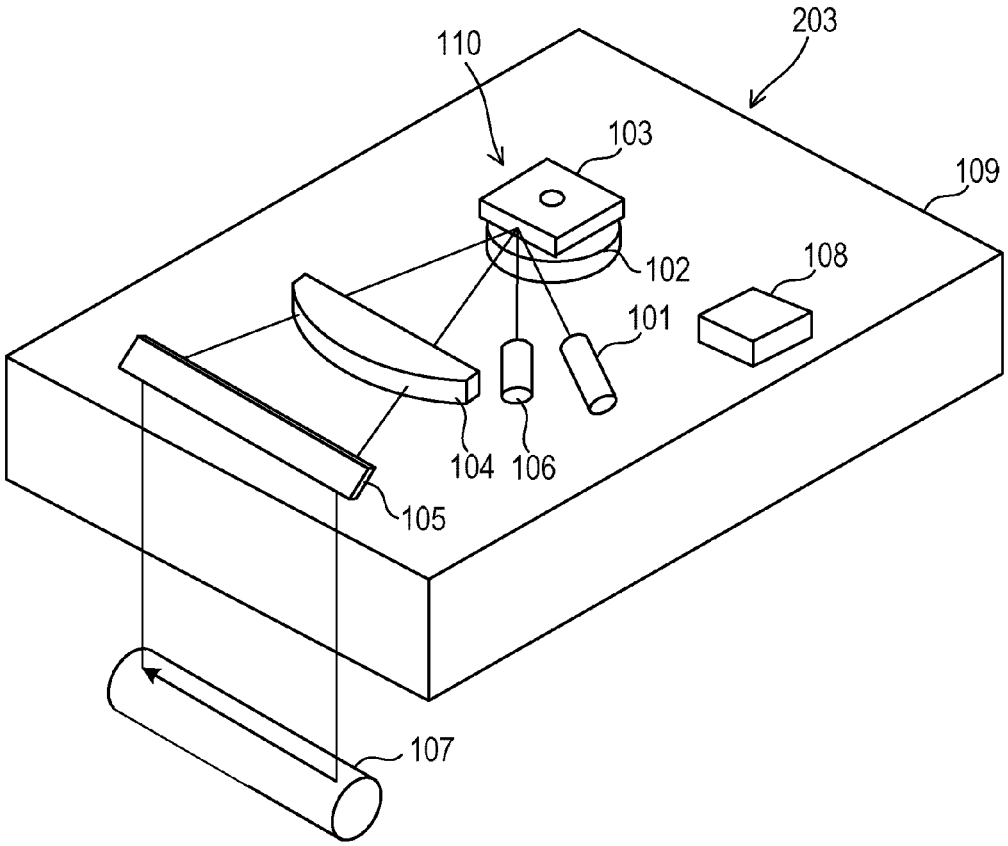
FIG. 3 is a view illustrating a structure of a light scanning apparatus.

FIG. 3 illustrates a structure of the light scanning apparatus 203.

The light scanning apparatus 203 includes a light source (laser diode) 101, a deflecting unit 110, a thermistor (temperature detecting unit) 108, and an optical box 109. The light source 101 emits a light beam modulated according to the image data from the controller unit 300 to form an electrostatic latent image on the photosensitive drum 107. The deflecting unit 110 includes a rotary polygon mirror 103 and a motor (rotary polygon mirror driving motor) 102 configured to rotate the rotary polygon mirror 103. The deflecting unit 110 deflects the light beam so that the light beam scans the photosensitive drum 107.

The optical box 109 houses the rotary polygon mirror 103, the thermistor 108, an imaging lens 104, a reflecting mirror 105, and a beam detecting sensor 106.

The light source 101 emits the light beam modulated according to the image data. The light beam is deflected (reflected) by the rotary polygon mirror 103 which is rotated by the motor 102. The deflected light beam passes through the imaging lens 104, is reflected by the reflecting mirror 105, and reaches the photosensitive drum 107 to form an electrostatic latent image on the photosensitive drum 107.

The beam detecting sensor 106 detects light reflected by the rotary polygon mirror 103. A result of the detection by the beam detecting sensor 106 is used for determining timing for writing an image onto the photosensitive drum 107.

The thermistor 108 detects a temperature in the light scanning apparatus 203, and outputs the detected value (detected temperature) to the CPU 301. In this embodiment, the thermistor 108 is disposed in the optical box 109 to detect an ambient temperature of the motor 102, but the embodiment is not limited thereto. The thermistor 108 may directly detect a temperature of the motor 102. Alternatively, the thermistor 108 may be disposed in the main body (housing) 100A of the image forming apparatus 100 and out of the housing of the light scanning apparatus to detect a temperature in the image forming apparatus 100.

(Controller Unit)

FIG. 4 is a block diagram of the controller unit 300. The controller unit 300 includes the CPU 301, a ROM 302, the RAM 303, a real-time clock 304, and a rotary polygon mirror driving motor control IC (hereinafter referred to as a motor control circuit) 305.

The CPU 301 is electrically connected to the ROM 302, the RAM 303, the real-time clock 304, and the motor control circuit 305. The CPU 301 controls the entire controller unit 300. The ROM 302 stores programs to be run on the CPU 301. The RAM 303 is used by the CPU 301 for temporarily storing data. The real-time clock 304 outputs data of a current time to the CPU 301. The motor control circuit 305 controls rotation of the motor 102 in the light scanning apparatus 203 in accordance with a command from the CPU 301. The thermistor 108 in the light scanning apparatus 203 detects the temperature in the light scanning apparatus 203, and outputs the detected value to the CPU 301. The beam detecting sensor 106 in the light scanning apparatus 203 detects the light beam deflected by the rotary polygon mirror 103, and outputs to the CPU 301 a synchronizing signal (hereinafter referred to as a BD signal) for keep print positions of the images in a main scanning direction constant.

Further, the CPU 301 is electrically connected to the pressure cover opening and closing detecting sensor 220. The CPU 301 determines the opening or closing state of the original pressure cover 219 based on a detection signal from the pressure cover opening and closing detecting sensor 220.

Next, rotation control of the motor 102 will be described with reference to FIG. 4.

The rotation of the motor 102 is controlled by the controller unit 300. The motor 102 outputs a pulse signal (hereinafter referred to as a FG signal) which is proportional to a rotation speed of the motor 102 by using an internal circuit (for example, FG pattern) of the motor 102. Note that, in the embodiment, the rotary polygon mirror 103 is fixed to a rotation shaft of the motor 102, and thus, the rotation speed of the motor 102 as used herein means a rotation speed of the rotary polygon mirror 103. Further, rotating the motor 102 as used herein means rotating the rotary polygon mirror 103, and starting the rotation of the motor 102 as used herein means starting the rotation of the rotary polygon mirror 103.

The CPU 301 outputs an acceleration signal (hereinafter referred to as an ACC signal) for accelerating the motor 102, or a deceleration signal (hereinafter referred to as a DEC signal) for decelerating the motor 102 to the motor control circuit 305. When the motor control circuit 305 receives an ACC signal, the motor control circuit 305 charges a capacitor for accelerating the motor 102. When the motor control circuit 305 receives a DEC signal, the motor control circuit 305 discharges the capacitor for decelerating the motor 102. After that, when the FG signal falls within a predetermined range, the CPU 301 changes a command value from the motor control circuit 305 to control the rotation speed so that an interval between BD signals which are output from the beam detecting sensor 106 falls within a predetermined range.

Figure 5A:
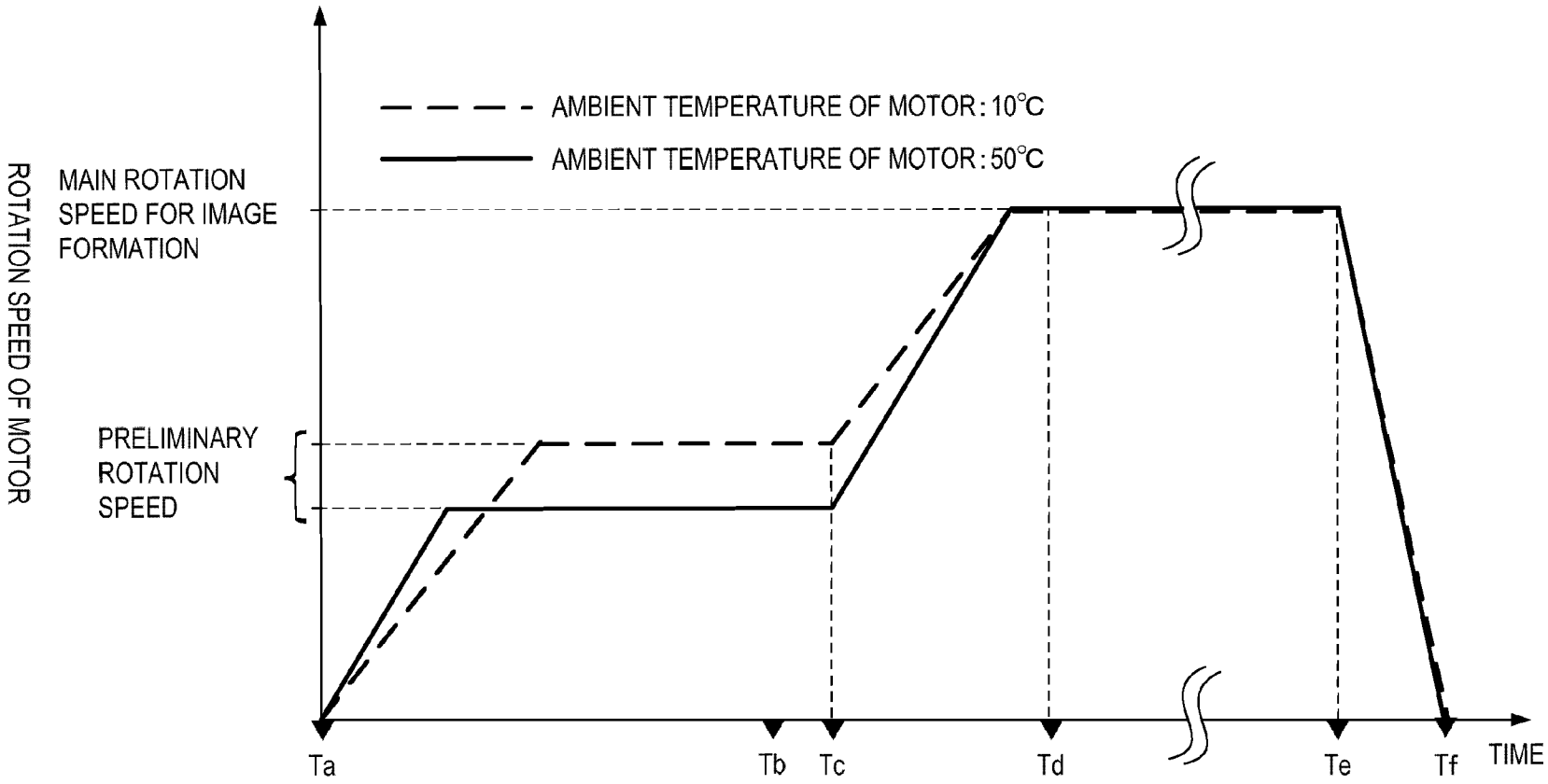
FIGS. 5A and 5B are graphs showing a relationship between time and a rotation speed of a motor in the embodiments.
Figure 5B:
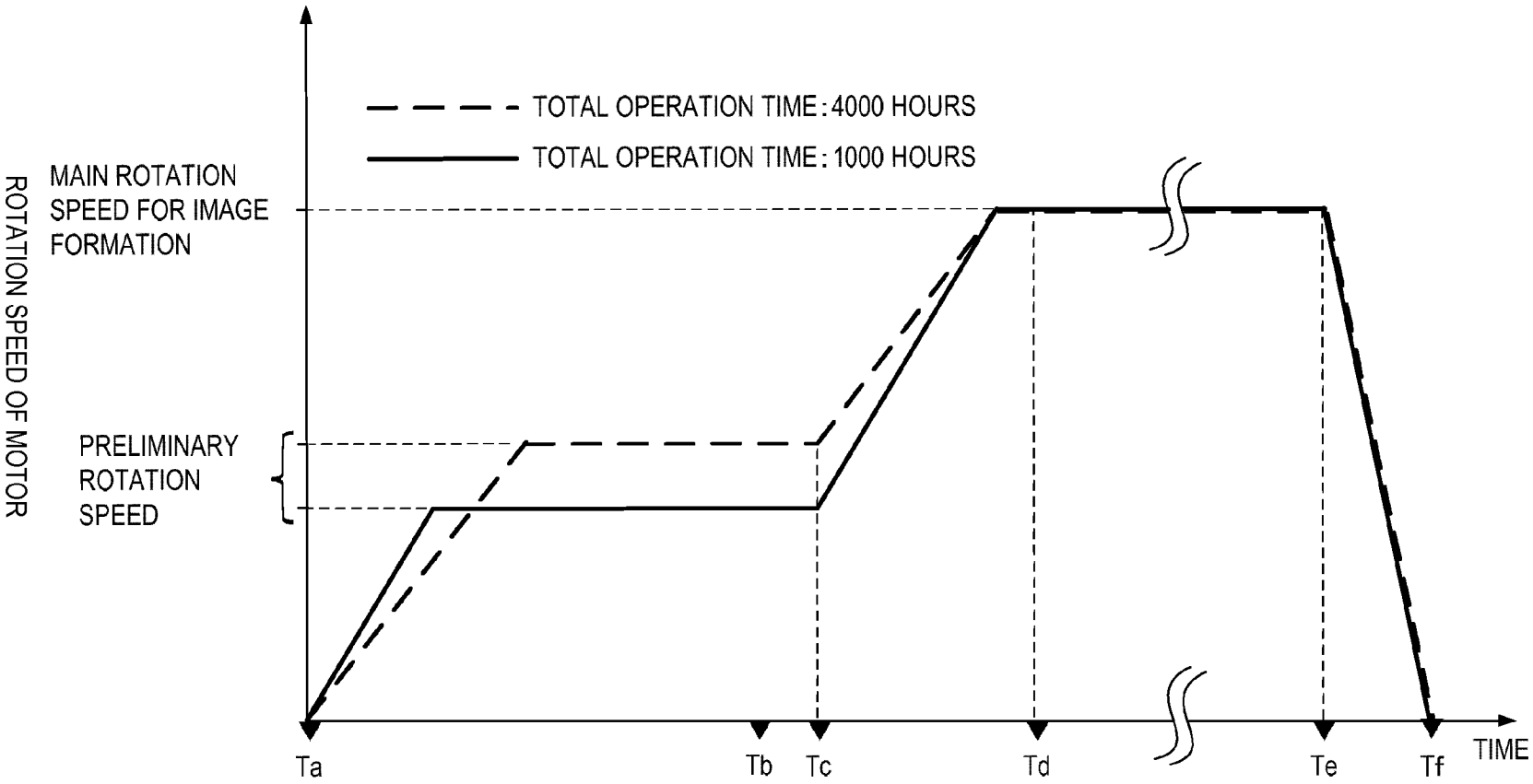

FIG. 5A and FIG. 5B are graphs showing a relationship between time and the rotation speed of the motor 102 in this embodiment. FIG. 5A is a graph showing a relationship between time and the rotation speed of the motor in the first embodiment and a second embodiment described later. FIG. 5B is a graph showing a relationship between time and the rotation speed of the motor in a third embodiment described later.

With reference to FIG. 5A and FIG. 5B, when a pre-operation is performed (Ta), the CPU 301 starts a pre-rotation of the motor 102 via the motor control circuit 305. The pre-operation involves, for example, an image data transferring operation from the original reading apparatus 218 to the controller unit 300, a turning-on operation of a main power supply of the image forming apparatus 100, and an opening and closing operation of a door (not shown) of the main body 100A of the image forming apparatus 100 or an opening and closing operation of the original pressure cover 219. Further, the pre-operation may involve a placement operation of the original D on the original tray 235, a pressing-down operation of the setting buttons 246 and 247, a pressing-down operation of the START key 243, and a processing operation of the touch panel display 241.

Before a command for starting to copy is issued, that is, before a start signal for instructing a start of image formation is generated, the CPU 301 pre-rotates the motor 102, that is, the rotary polygon mirror 103. When the pre-operation is performed (Ta), the CPU 301 accelerates the motor 102 until a rotation speed of pre-rotation (hereinafter referred to as a preliminary rotation speed) is reached. In a state in which the motor 102 rotates at the preliminary rotation speed, when the START key 243 configured to issue the command for starting to copy (start signal for instructing a start of image formation) is pressed down by a user (Tb), the controller unit 300 starts to rotate the photosensitive drum 107 (Tc).

When the rotation of the photosensitive drum 107 is started (Tc), the CPU 301 starts to accelerate the motor 102 from the preliminary rotation speed to a main rotation speed. In a state in which the motor 102 rotates at the main rotation speed with stability, the CPU 301 starts formation of an electrostatic latent image on the photosensitive drum 107 by using a light beam from the light scanning apparatus 203 (Td). When the formation of the electrostatic latent image is completed (Te), the CPU 301 stops the motor 102 (Tf).

Note that, in this embodiment, the CPU 301 accelerates the motor 102 from the preliminary rotation speed to the main rotation speed in response to the start of the rotation of the photosensitive drum 107 after the pressing-down operation of the START key 243, but the embodiment is not limited thereto. The acceleration of the motor 102 may be started in accordance with a predetermined operation such as a form feed signal after the pressing-down operation of the START key 243.

By the way, in order not to increase a first copy output time, the motor 102 is required to rotate with stability at the main rotation speed before the start the formation of the latent image (Td). A rise time required from a stopped state of the motor 102 until the motor 102 reaches the main rotation speed for image formation depends on a temperature and a total operation time of the motor 102.

When the ambient temperature of the motor 102 is 50° C. (solid line in FIG. 5A), the rise time of the motor 102 is short, and thus, the preliminary rotation speed of the motor 102 during a pre-operation period is set to be low. On the other hand, when the ambient temperature of the motor 102 is 10° C. (broken line in FIG. 5A), the rise time of the motor 102 is long, and thus, the preliminary rotation speed is set to be high.

In the embodiments (first and second embodiments) shown in FIG. 5A, a target value of the preliminary rotation speed of the motor 102 is set based on a result of detection (temperature) by the thermistor 108. Note that, a correlation between the result of the detection by the thermistor 108 and the rotation speed of the motor 102 is obtained at the time of design or at the time of assembly in a factory. Further, the CPU 301 may serve as an estimating unit configured to estimate the rise time of the motor 102 based on the result of the detection by the thermistor 108, and may set the target value of the preliminary rotation speed of the motor 102 in accordance with the estimated rise time (result of estimation).

Further, when the total operation time of the motor 102 is 1,000 hours (solid line in FIG. 5B), the rise time of the motor 102 is short, and thus, the preliminary rotation speed of the motor 102 during the pre-operation period is set to be low. On the other hand, when the total operation time of the motor 102 is 4,000 hours (broken line in FIG. 5B), the rise time of the motor 102 is long, and thus, the preliminary rotation speed is set to be high.

In the embodiment (third embodiment) shown in FIG. 5B, the target value of the preliminary rotation speed of the motor 102 is set based on the total operation time of the motor 102. Note that, the CPU 301 may serve as an estimating unit configured to estimate the rise time of the motor 102 based on the total operation time of the motor 102, and may set the target value of the preliminary rotation speed of the motor 102 in accordance with the estimated rise time (result of estimation).

In this way, by lowering the preliminary rotation speed of the rotary polygon mirror 103 when the rise time is short, noise due to wind noise of the rotary polygon mirror 103 can be reduced and shortening of a life-time of the motor 102 can be suppressed.

(Motor Control Operation by CPU)

Figures 6A, 6B:
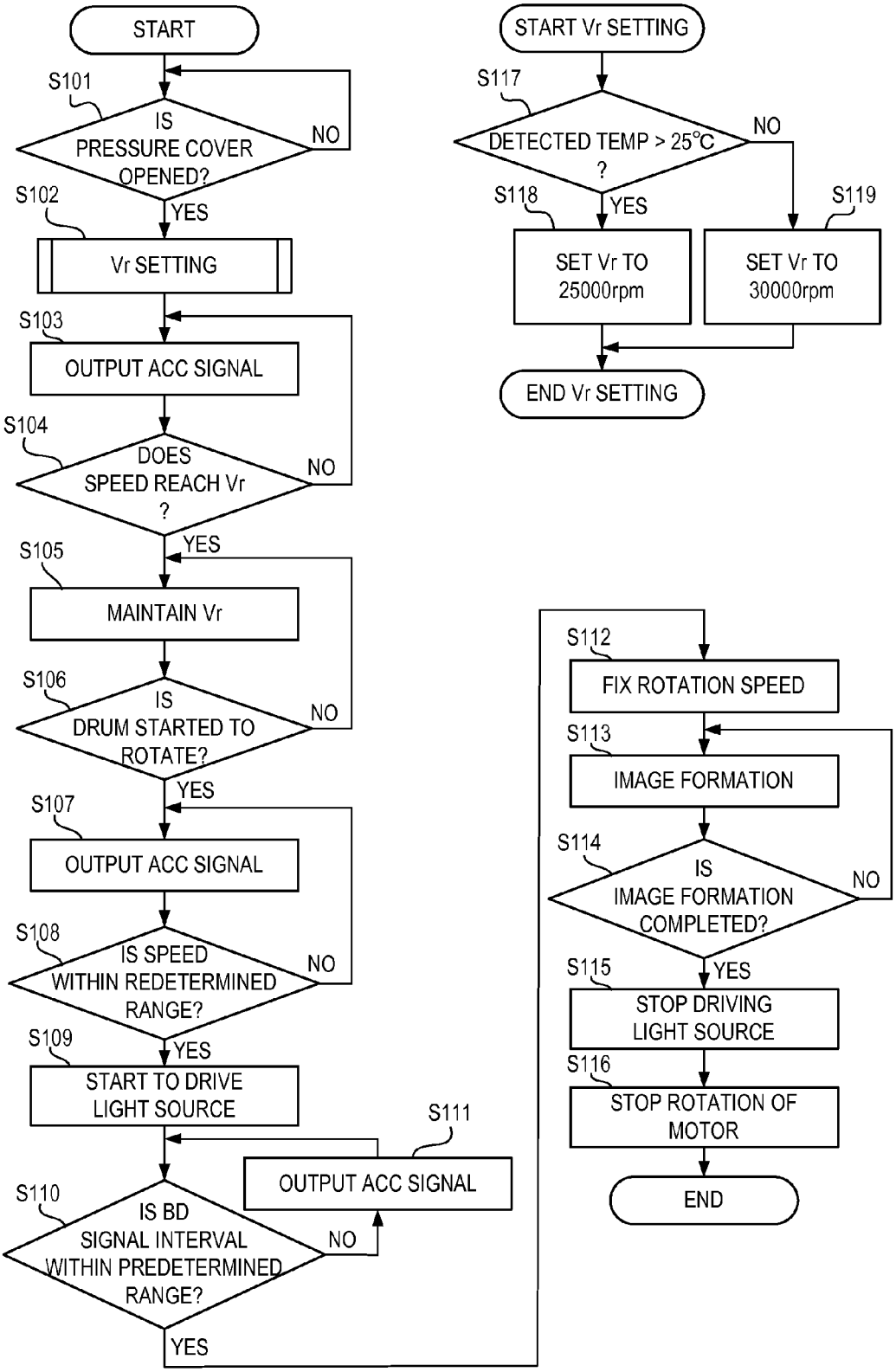
FIGS. 6A and 6B are flowcharts illustrating control operation of the motor according to the first embodiment.

FIG. 6A and FIG. 6B are flowcharts illustrating control operation of the motor 102 by the CPU 301. The CPU 301 executes the control operation of the motor 102 in accordance with a program stored in the ROM 302.

As illustrated in FIG. 6A, the CPU 301 determines whether or not the original pressure cover 219 is opened based on the detection signal from the pressure cover opening and closing detecting sensor 220 (S101). When it is determined that the original pressure cover 219 is opened (YES in Step S101), the CPU 301 sets a target value of a preliminary rotation speed Vr for the pre-rotation in the motor control circuit (setting unit) 305 (S102).

FIG. 6B is a flowchart illustrating a subroutine of setting the preliminary rotation speed Vr according to the first embodiment.

Figure 9A:
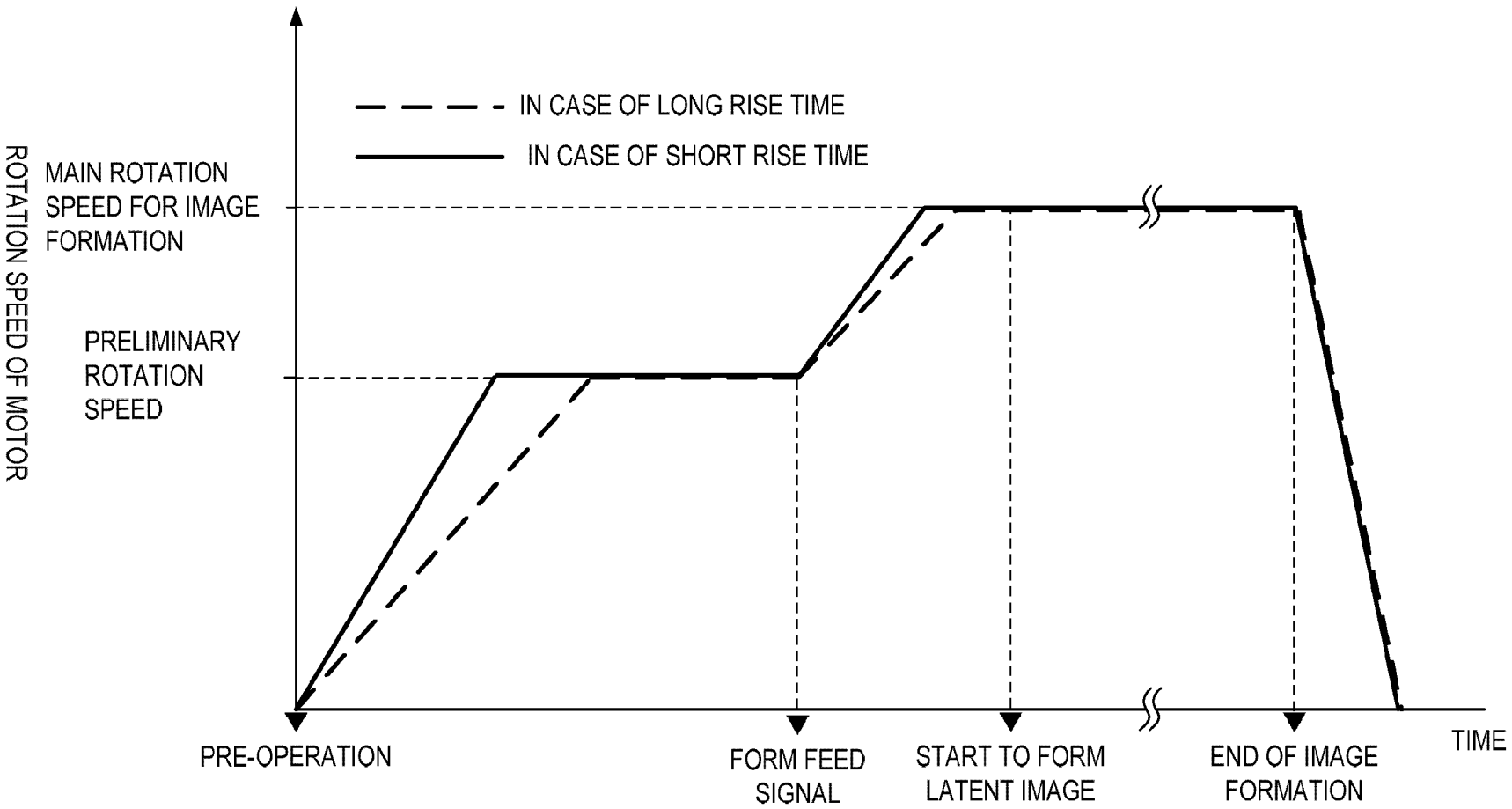
FIGS. 9A, 9B, and 9C are graphs showing characteristics of the motor.
Figure 9B:
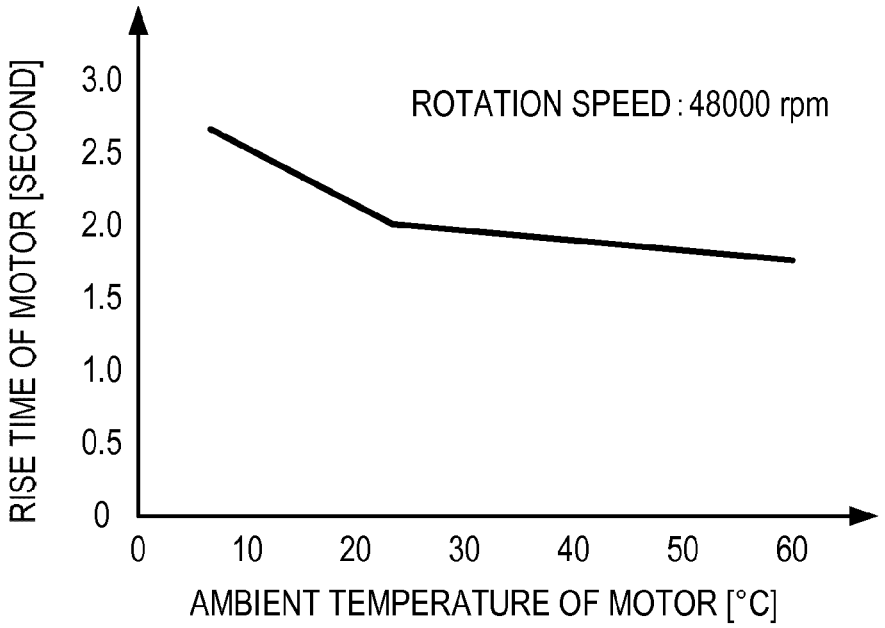

By the way, as shown in FIG. 9B, a slope of the rise time of the motor 102 with respect to the ambient temperature greatly changes at a point where the ambient temperature of the motor 102 is 25° C. Therefore, in this embodiment, 25° C. is regarded as a threshold value. Note that, the threshold value is not limited to 25° C., and depends on specifications of the motor 102, a structure of the optical box 109, and the like.

With reference to FIG. 6B, the CPU 301 determines whether or not the detected temperature (result of detection) by the thermistor 108 is higher than 25° C. as the threshold value (S117). When it is determined that the detected temperature is not higher than 25° C. (NO in Step S117), that is, the detected temperature is a first temperature that is equal to or lower than 25° C., the CPU 301 sets the target value of the preliminary rotation speed Vr to be 30,000 rpm as a first rotation speed (S119). When it is determined that the detected temperature is higher than 25° C. (YES in Step S117), the CPU 301 sets the target value of the preliminary rotation speed Vr to be 25,000 rpm as a second rotation speed (S118). In other words, when the detected temperature is a second temperature that is higher than the first temperature, the CPU 301 sets the target value of the preliminary rotation speed Vr to be the second rotation speed that is lower than the first rotation speed.

In other words, the CPU 301 sets the target value of the preliminary rotation speed of the motor 102 based on the detected temperature by the thermistor 108.

Reference is again made to FIG. 6A. Next, the CPU 301 outputs an ACC signal for accelerating the rotation of the motor 102 to the motor control circuit 305 (S103). When the motor control circuit 305 receives the ACC signal from the CPU 301, the motor control circuit 305 starts the rotation of the motor 102, and accelerates the motor 102 in a state of detecting an FG signal from the motor 102.

The CPU 301 determines whether or not the rotation speed of the motor 102 reaches the preliminary rotation speed Vr based on an FG signal from the motor 102 (S104). When it is determined that the rotation speed of the motor 102 does not reach the preliminary rotation speed Vr (NO in Step S104), the process returns to Step S103, and the CPU 301 outputs an ACC signal to the motor control circuit 305 to accelerate the motor 102. On the other hand, when it is determined that the rotation speed of the motor 102 reaches the preliminary rotation speed Vr (YES in Step S104), the CPU 301 maintains the rotation speed of the motor 102 at the preliminary rotation speed Vr (S105). In Step S105, the CPU 301 outputs an ACC signal or a DEC signal to the motor control circuit 305 and maintains the preliminary rotation speed Vr.

After that, when the START key 243 configured to issue the command for starting to copy is pressed down by a user, the rotation of the photosensitive drum 107 is started. The CPU 301 determines whether or not the rotation of the photosensitive drum 107 is started (S106). When it is determined that the rotation of the photosensitive drum 107 is not started (NO in Step S106), the process returns to Step S105, and the CPU 301 maintains the preliminary rotation speed Vr. On the other hand, when it is determined that the rotation of the photosensitive drum 107 is started (YES in Step S106), the CPU 301 outputs an ACC signal for accelerating the motor 102 to the motor control circuit 305 (S107). When the motor control circuit 305 receives the ACC signal from the CPU 301, the motor control circuit 305 accelerates the motor 102 in a state of detecting an FG signal from the motor 102. In other words, the CPU 301 starts the acceleration of the motor 102 in a state in which the start of the rotation of the photosensitive drum after the START key 243 is pressed down acts as a trigger, and rotates the motor 102 at the main rotation speed used for image formation.

The CPU 301 determines whether or not the rotation speed of the motor 102 falls within a predetermined range (S108). In this embodiment, the predetermined range of the rotation speed is, for example, a range from the main rotation speed of the motor 102 minus 6% to the main rotation speed. In this case, the main rotation speed of the motor 102 is the rotation speed of the rotary polygon mirror 103 for image formation. For example, in Step S108, the CPU 301 determines whether or not the rotation speed of the motor 102 falls within the predetermined range by determining whether or not the rotation speed of the motor 102 reaches 94% of the main rotation speed based on an FG signal from the motor 102.

When it is determined that the rotation speed of the motor 102 does not fall within the predetermined range (NO in Step S108), the process returns to Step S107, and the CPU 301 outputs an ACC signal for accelerating the motor 102 to the motor control circuit 305. On the other hand, when it is determined that the rotation speed of the motor 102 falls within the predetermined range (YES in Step S108), the CPU 301 starts to drive the light source 101 to emit a light beam (S109).

The beam detecting sensor 106 receives the light beam from the light source 101 and outputs a BD signal to the CPU 301. The CPU 301 determines whether or not an interval between BD signals which are output from the beam detecting sensor 106 falls within a predetermined range (S110). In the embodiment, the predetermined range of an interval between BD signals is, for example, a range from a target interval between BD signals plus 3% to the target interval. In this case, the target interval between BD signals is the interval between BD signals when the rotary polygon mirror 103 is rotated at the main rotation speed for image formation. For example, in Step S110, the CPU 301 determines whether or not the interval between BD signals falls within the predetermined range by determining whether or not the interval between BD signals reaches 103% or less of the target interval.

When it is determined that the interval between BD signals does not fall within the predetermined range (NO in Step S110), the CPU 301 outputs an ACC signal for accelerating the motor 102 to the motor control circuit 305 (S111). On the other hand, when it is determined that the interval between BD signals falls within the predetermined range (YES in Step S110), the CPU 301 outputs a command for fixing the rotation speed of the motor 102 to the motor control circuit 305 (S112). This rotates the rotary polygon mirror 103 approximately at the main rotation speed.

The CPU 301 causes the image forming portion 100B to execute image formation in a state in which the rotary polygon mirror 103 is rotated approximately at the main rotation speed (S113). The CPU 301 determines whether or not the image formation is completed (S114). When it is determined that the image formation is not completed (NO in Step S114), the process returns to Step S113 and the image formation is continued. On the other hand, when it is determined by the CPU 301 that the image formation is completed (YES in Step S114), the CPU 301 stops driving the light source 101 (S115) and stops the rotation of the motor 102 (S116).

In the embodiment, the thermistor 108 detects the temperature in the light scanning apparatus 203, and based on the detected temperature, the target value of the preliminary rotation speed Vr is set. When the temperature of the motor 102 is high, the rise time of the motor 102 is short, and thus, based on the detected temperature in the light scanning apparatus 203, the preliminary rotation speed Vr of the motor 102 for the pre-rotation can be reduced from the first rotation speed to the second rotation speed. Therefore, noise of the motor can be reduced and the life-time of the motor can be increased without increasing a time period (first copy output time) from when a start signal for instructing the start of the image formation is generated to when the electrostatic latent image formation is started. Note that, the CPU 301 may set the target value of the preliminary rotation speed Vr to be 30,000 rpm when a result T of the detection by the thermistor 108 satisfies $T \leq 25°$ C., and the CPU 301 may set the target value of the preliminary rotation speed Vr to be 25,000 rpm when $25° C. < T \leq 55°$ C. The CPU 301 may set the target value of the preliminary rotation speed Vr to be 22,000 rpm when $55° C. < T$.

Note that, in the embodiment, the temperature in the light scanning apparatus 203 is detected, but the temperature of the motor 102 may be directly detected and the target value of the preliminary rotation speed Vr of the motor 102 may be set based on the detected temperature of the motor 102. In other words, the target value of the rotation speed of the rotary polygon mirror 103 for the pre-rotation may be set based on the detected temperature of the motor 102.

Further, the temperature in the main body (housing) 100A of the image forming apparatus 100 may be detected and the target value of the rotation speed of the rotary polygon mirror 103 for the pre-rotation may be set based on the detected temperature.

Second Embodiment

Next, the second embodiment will be described. In the first embodiment, the target value of the rotation speed of the rotary polygon mirror 103 for the pre-rotation is changed in accordance with the result of the detection by the thermistor 108. In the second embodiment, the target value of the rotation speed of the rotary polygon mirror 103 for the pre-rotation is changed in accordance with a lapsed time (hereinafter referred to as a lapsed time between image formations) from when the previous image formation was completed until the current pre-operation is started. Therefore, the CPU 301 writes a time, at which the previous image formation was completed, to the RAM 303 and calculates the lapsed time between image formations when the current pre-operation is started.

The image forming apparatus, the reading apparatus, the operating portion, and the light scanning apparatus in the second embodiment are similar to those in the first embodiment, and thus, a description thereof is omitted.

(Motor Control Operation by CPU)

Figures 7A, 7B:
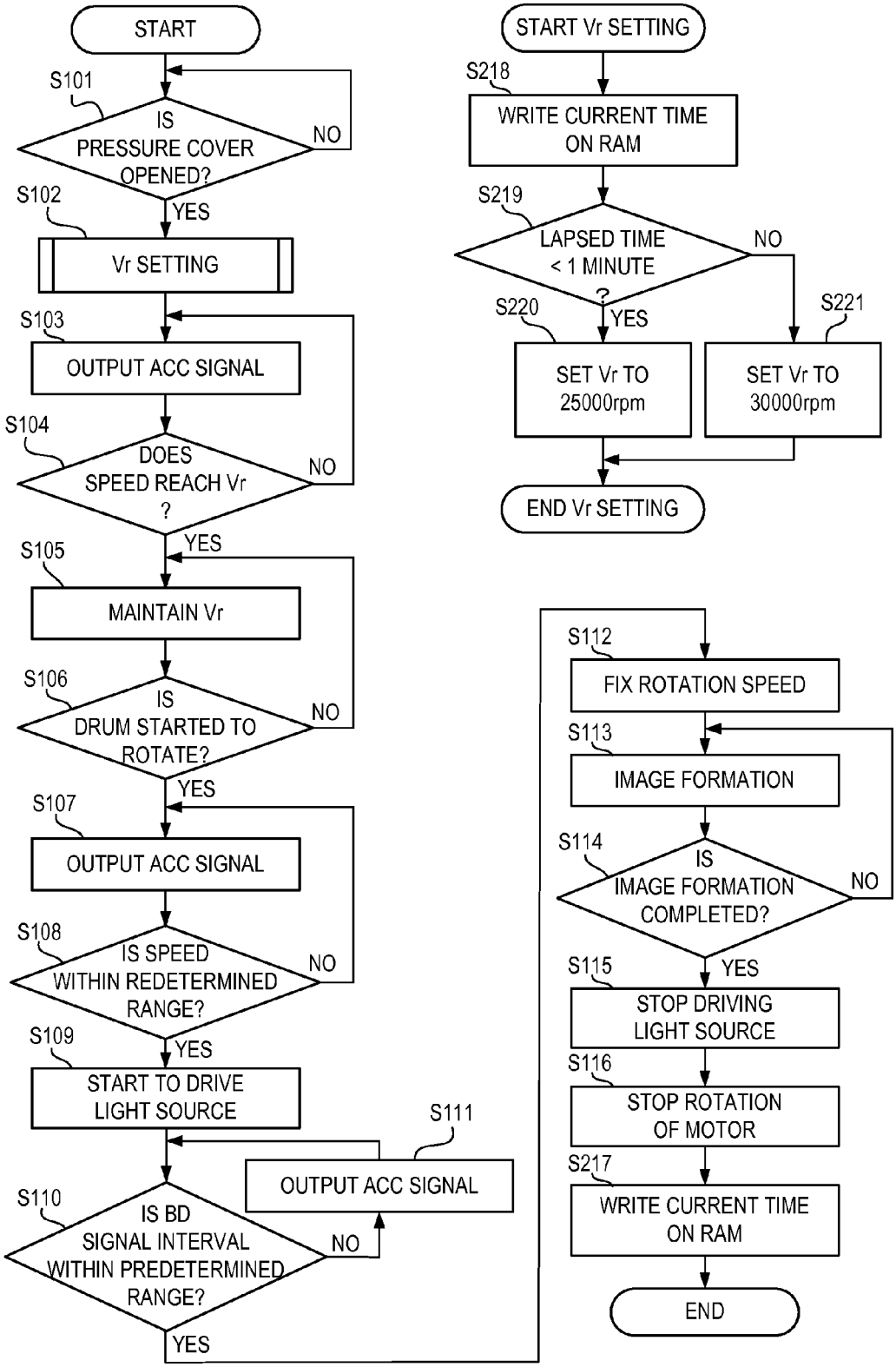
FIGS. 7A and 7B are flowcharts illustrating control operation of the motor according to a second embodiment.

FIG. 7A and FIG. 7B are flowcharts illustrating control operation of the motor 102 by the CPU 301. The CPU 301 executes the control operation of the motor 102 in accordance with a program stored in the ROM 302.

With reference to FIG. 7A, similar reference numerals are used to designate similar steps to those in FIG. 6A, and a description thereof is omitted. The flowchart of FIG. 7A is different from the flowchart of FIG. 6A in that, after the rotation of the motor 102 is stopped (S116), the CPU 301 writes to the RAM 303 a current time obtained from the real-time clock 304 (S217). In other words, in Step S217, the CPU 301 writes to the RAM 303 the time of day at which the image formation is completed.

As illustrated in FIG. 7A, the CPU 301 determines whether or not the original pressure cover 219 is opened based on the detection signal from the pressure cover opening and closing detecting sensor 220 (S101). When it is determined that the original pressure cover 219 is opened (YES in Step S101), the CPU 301 sets the preliminary rotation speed Vr in the motor control circuit 305 (S102).

FIG. 7B is a flowchart illustrating a subroutine of setting the preliminary rotation speed Vr according to the second embodiment. When it is determined that the original pressure cover 219 is opened (YES in Step S101), the CPU 301 writes to the RAM 303 the current time obtained from the real-time clock 304 (S218). In other words, in Step S218, the CPU 301 writes to the RAM 303 the time of day at which the original pressure cover 219 is opened (time of day at which the pre-operation is started).

The CPU 301 determines, based on the time of day at which the previous image formation was completed obtained in Step S217 and the time of day at which the current pre-operation is started obtained in Step S218, the lapsed time from when the previous image formation was completed (lapsed time between image formations). Alternatively, the real-time clock 304 may have the function of counting the lapsed time from when the previous image formation was completed, and the counted value may be output to the CPU 301.

By the way, the temperature of the motor 102 becomes high when the lapsed time between image formations is short, and becomes low when the lapsed time is long. Therefore, a lapsed time (for example, 1 minute) obtained when the temperature of the motor 102 is, for example, higher than 25° C. and the rise time is short is regarded as the threshold value. In this embodiment, 1 minute is regarded as a threshold value. Note that, the threshold value is not limited to 1 minute. The threshold value may be changed depending on the specifications of the motor 102 the structure of the optical box 109.

The CPU 301 determines whether or not the lapsed time between image formations is shorter than 1 minute as the threshold value (S219). When it is determined that the lapsed time is not shorter than 1 minute (NO in Step S219), that is, when the lapsed time is a first time period, the CPU 301 sets the target value of the preliminary rotation speed Vr to be 30,000 rpm as the first rotation speed (S221). In other words, when the lapsed time is equal to or longer than 1 minute, the temperature of the motor 102 is estimated to be equal to or lower than 25° C., and thus, the target value of the preliminary rotation speed Vr is changed to a higher value.

When it is determined that the lapsed time is shorter than 1 minute (YES in Step S219), that is, when the lapsed time is a second time period which is shorter than the first time period, the CPU 301 sets the target value of the preliminary rotation speed Vr to be 25,000 rpm as the second rotation speed that is lower than the first rotation speed (S220). In other words, when the lapsed time is shorter than 1 minute, the temperature of the motor 102 is estimated to be higher than 25° C., and thus, the target value of the preliminary rotation speed Vr is changed to a lower value.

In the second embodiment, when the lapsed time from when the previous image formation was completed is short, the temperature of the motor 102 is estimated to be kept high, and thus, the target value of the preliminary rotation speed Vr is set to be a low value.

In other words, the CPU 301 sets the target value of the preliminary rotation speed of the motor 102 based on the lapsed time between image formations which is determined using the real-time clock 304.

According to the embodiment, the preliminary rotation speed Vr for the pre-rotation when the temperature of the motor 102 is high and the rise time is short can be reduced. Therefore, the noise of the motor can be reduced and the life-time of the motor can be increased without increasing the time period (first copy output time) from when the start signal for instructing the start of the image formation is generated to when the electrostatic latent image formation is started.

In the second embodiment, the CPU 301, the RAM 303, and the real-time clock 304 construct a lapsed time obtaining unit configured to measure the lapsed time from when the previous image formation was completed until the current pre-operation is started (rotation of the motor 102 is started). Note that, the real-time clock 304 may have the counting function of measuring the lapsed time from when the previous image formation was completed until the current pre-operation is started. Alternatively, instead of the real-time clock 304, a timer may be used. The CPU 301 may determine whether or not the time period measured by the timer reaches a predetermined time period, and may change the target value of the preliminary rotation speed Vr based on a result of the determination.

Third Embodiment

Next, the third embodiment will be described. In the first embodiment and the second embodiment, the target value of the rotation speed of the rotary polygon mirror 103 for the pre-rotation is changed in accordance with the estimated temperature of the motor 102 (detected temperature or lapsed time). In the third embodiment, the target value of the rotation speed of the rotary polygon mirror 103 for the pre-rotation is changed in accordance with the total operation time of the motor 102. Therefore, the CPU 301 determines the total operation time of the motor 102, and writes the determined total operation time to the RAM 303.

The image forming apparatus, the reading apparatus, the operating portion, and the light scanning apparatus in the third embodiment are similar to those in the first embodiment, and thus, a description thereof is omitted.

(Motor Control Operation by CPU)

Figures 8A, 8B:
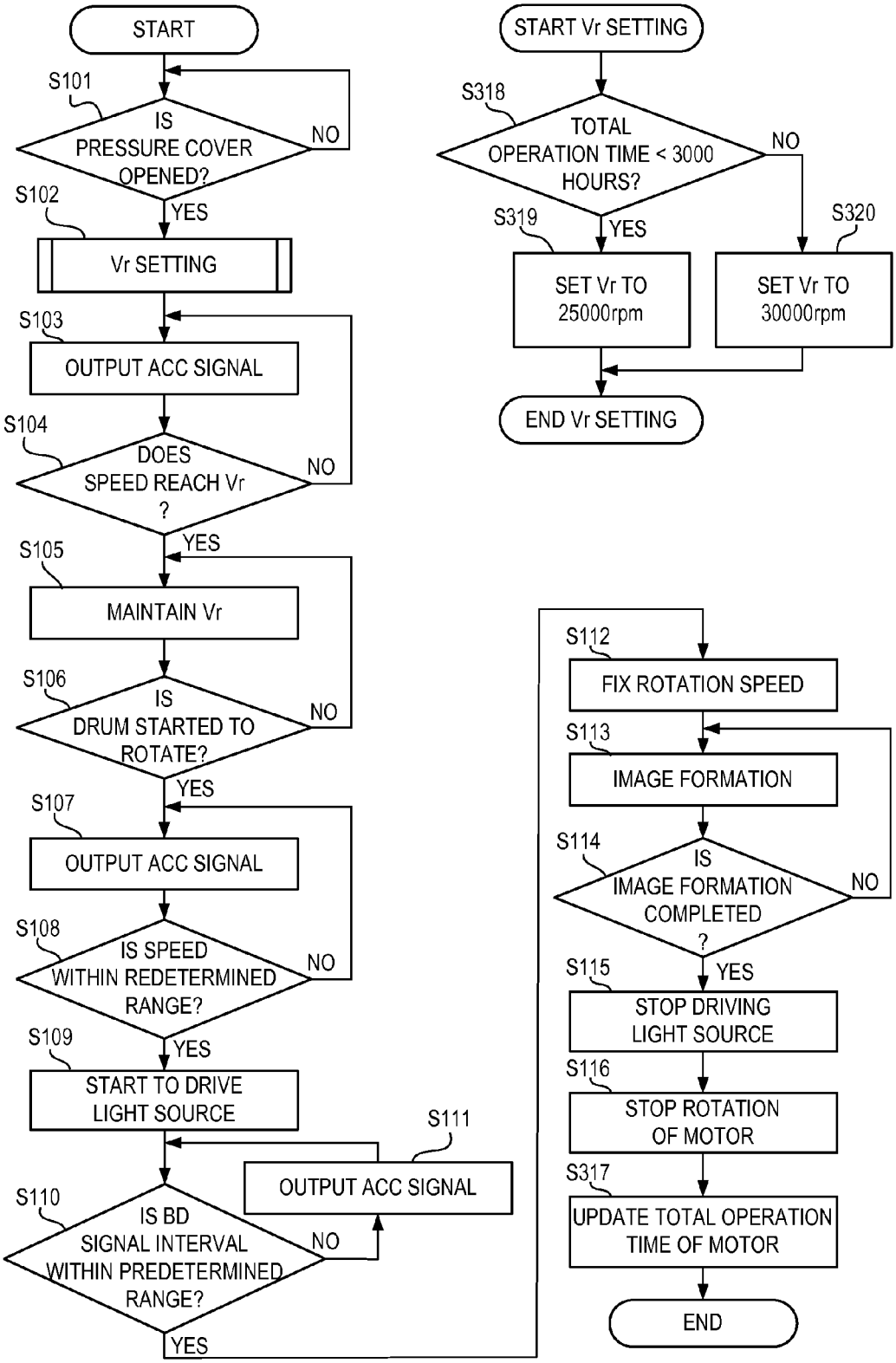
FIGS. 8A and 8B are flowcharts illustrating control operation of the motor according to a third embodiment.

FIG. 8A and FIG. 8B are flowcharts illustrating control operation of the motor 102 by the CPU 301. The CPU 301 executes the control operation of the motor 102 in accordance with a program stored in the ROM 302.

With reference to FIG. 8A, like reference numerals are used to designate steps similar to those in FIG. 6A, and description thereof is omitted. The flowchart of FIG. 8A is different from the flowchart of FIG. 6A in the following point.

The CPU 301 stops the rotation of the motor 102 (S116), and after that, writes to the RAM 303 the current time obtained from the real-time clock 304. The CPU 301 calculates the total operation time of the motor 102 based on the time of day written to the RAM 303, and updates the total operation time stored in the RAM 303 (S317).

Note that, the real-time clock 304 may have the function of counting, and the total operation time may be determined from the real-time clock 304. Alternatively, a timer may be additionally provided and the total operation time may be determined from the timer.

As illustrated in FIG. 8A, the CPU 301 determines whether or not the original pressure cover 219 is opened based on the detection signal from the pressure cover opening and closing detecting sensor 220 (S101). When it is determined that the original pressure cover is opened (YES in Step S101), the CPU 301 sets the preliminary rotation speed Vr in the motor control circuit 305 (S102).

FIG. 8B is a flowchart illustrating a subroutine of setting the preliminary rotation speed Vr according to the third embodiment.

Figure 9C:
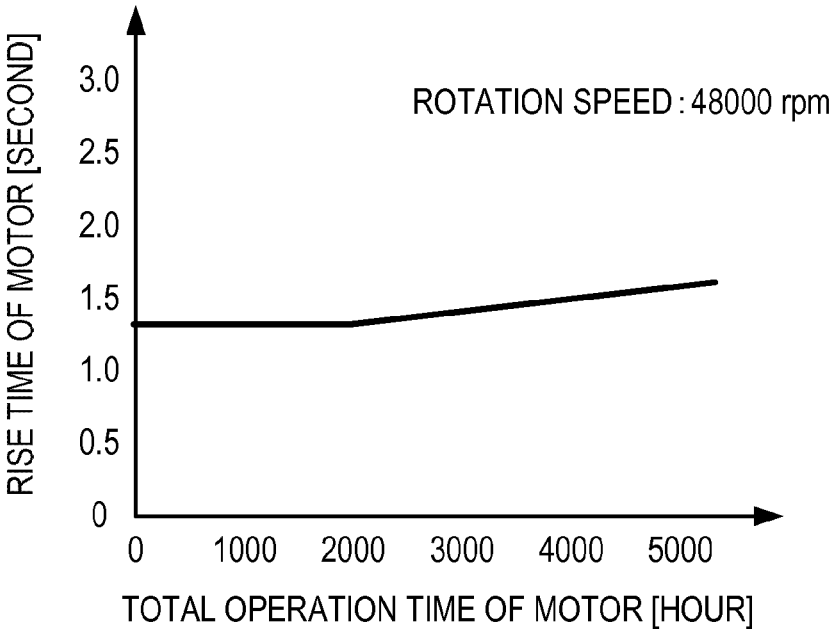

By the way, as shown in FIG. 9C, after the total operation time of the motor 102 exceeds 2,000 hours, the rise time of the motor 102 gradually becomes longer. Therefore, in the embodiment, 3,000 hours at which the rise time of the motor 102 becomes long to some extent is regarded as the threshold value. Note that, the threshold value is not limited to 3,000 hours. The threshold value may be changed depending on the specifications of the motor 102 and the structure of the optical box 109.

With reference to FIG. 8B, when it is determined that the original pressure cover 219 is opened (YES in Step S101), the CPU 301 determines whether or not the total operation time of the motor 102 written to the RAM when the previous image formation was completed in Step S317 is shorter than 3,000 hours as the threshold value (S318). When it is determined that the total operation time of the motor 102 is not shorter than 3,000 hours (NO in Step S318), that is, when the total operation time is a first time period, the CPU 301 sets the target value of the preliminary rotation speed Vr to be 30,000 rpm as the first rotation speed (S320). When it is determined that the total operation time of the motor 102 is shorter than 3,000 hours (YES in Step S318), the CPU 301 sets the target value of the preliminary rotation speed Vr to be 25,000 rpm as the second rotation speed (S319). In other words, when the total operation time is a second time period which is shorter than the first time period, the CPU 301 sets the target value of the preliminary rotation speed Vr to be the second rotation speed which is lower than the first rotation speed.

In the third embodiment, when the total operation time is short, the rise time of the motor 102 is short, and thus, the target value of the preliminary rotation speed Vr is set to be the low value. This can reduce the rotation speed for the pre-rotation when the total operation time of the motor 102 is short and the rise time is short. Therefore, the noise of the motor 102 can be reduced and the life-time of the motor 102 can be increased without increasing the time period (first copy output time) from when the start signal for instructing the start of the image formation is generated to when the electrostatic latent image formation is started.

As described above, by setting the target value of the preliminary rotation speed in accordance with the temperature of the motor 102, the lapsed time between image formations, or the total operation time, the preliminary rotation speed for the pre-operation period can be set to be low when the rise time of the motor 102 is short. This can reduce the noise due to wind noise of the rotary polygon mirror 103 and can avoid shortening of the life-time of the motor 102.

In the third embodiment, the CPU 301, the RAM 303, and the real-time clock 304 construct a total operation time obtaining unit configured to determine the total operation time of the motor 102. Note that, the real-time clock 304 may have the counting function of measuring the total operation time of the motor 102. Alternatively, instead of the real-time clock 304, a timer may be used.

Note that, in the first to third embodiments, the preliminary rotation speed of the motor 102 is set to be 25,000 rpm or 30,000 rpm in accordance with the temperature or the total operation time of the motor 102. However, with use of a conversion formula or a conversion table, three or more kinds of the preliminary rotation speed may be set, or stepless setting may be made.

Further, in the embodiments described above, after it is confirmed that the FG signal from the motor 102 falls within the predetermined range of the main rotation speed for image formation, the light source 101 is driven to emit light, and the rotation of the motor 102 is controlled so that the interval between BD signals falls within the predetermined range. However, the timing of the start of light emission by the light source 101 is not limited thereto, and any timing during the rise time of the motor 102 may be used.

For example, light emission by the light source 101 may be started after the motor 102 is accelerated based on the FG signal from the motor 102 from the stopped state until the preliminary rotation speed is reached. The motor 102 may be accelerated until the main rotation speed for image formation is reached in a state in which light is emitted by the light source 101 and BD signals are detected.

Further, in the embodiments described above, the rotation of the motor 102 is started in a state in which the fact that the original pressure cover 219 is opened acts as a trigger.

However, as described above, the rotation of the motor 102 may be started in a state in which the image data transferring operation from the original reading apparatus 218 to the controller unit 300, the turning-on operation of the main power supply of the image forming apparatus 100, or the opening and closing operation of the door of the main body 100A of the image forming apparatus 100 acts as a trigger. Further, the rotation of the motor 102 may be started in a state in which the operation of placing the original D on the original tray 235, the pressing-down operation of the setting buttons 246 and 247, the pressing-down operation of the START key 243, or the processing operation of the touch panel display 241 acts as a trigger.

Further, in the embodiments described above, the target value of the preliminary rotation speed Vr is set in accordance with the ambient temperature of the motor 102, the lapsed time between image formations, or the total operation time of the motor 102, but the first rotation speed may be set in accordance with those conditions in combination.

In the embodiments described above, the first rotation speed is set to be 30,000 rpm and the second rotation speed is set to be 25,000 rpm, but the first rotation speed and the second rotation speed are not limited thereto. It is enough that the first rotation speed be higher than the second rotation speed. Further, it is enough that the first rotation speed and the second rotation speed be lower than the rotation speed for image formation.

According to the embodiments described above, the noise of the motor can be reduced and the life-time of the motor can be increased without increasing the time period from when the start signal for instructing the start of the image formation is generated to when the electrostatic latent image formation is started.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-231840, filed Nov. 8, 2013, which is hereby incorporated by reference herein in its entirety.

What is claimed is:

1. An image forming apparatus, comprising:

a photosensitive member;

a light source configured to emit a light beam based on image data to form an electrostatic latent image on the photosensitive member;

a deflecting unit configured to deflect the light beam so that the light beam scans the photosensitive member, the deflecting unit comprising a rotary polygon mirror and a motor configured to rotate the rotary polygon mirror;

a housing provided with the photosensitive member, the light source, and the deflecting unit;

a temperature detecting unit configured to detect a temperature of the motor; and a control unit configured to pre-rotate the rotary polygon mirror before a start signal for instructing a start of image formation is generated, and configured to rotate, after the start signal is generated, the rotary polygon mirror at a rotation speed which is higher than a rotation speed for pre-rotation of the rotary polygon mirror, wherein the control unit sets a target value of the rotation speed for the pre-rotation of the rotary polygon mirror based on a result of detection by the temperature detecting unit, and wherein, when the temperature detected by the temperature detecting unit is a first temperature, the control unit sets the target value to a first rotation speed, and, when the temperature detected by the temperature detecting unit is a second temperature which is higher than the first temperature, the control unit sets the target value to a second rotation speed which is lower than the first rotation speed.

2. An image forming apparatus according to claim 1, further comprising a setting unit in which the target value for the pre-rotation of the rotary polygon mirror is set, wherein the control unit sets the target value in the setting unit based on the result of the detection by the temperature detecting unit.

3. An image forming apparatus according to claim 1, further comprising a light scanning apparatus, the light scanning apparatus comprising:

the light source;

the rotary polygon mirror;

the temperature detecting unit; and an optical box containing the rotary polygon mirror and the temperature detecting unit, wherein the control unit sets the target value based on the result of the detection by the temperature detecting unit contained in the optical box.

4. An image forming apparatus according to claim 1, further comprising a reading apparatus, the reading apparatus comprising:

a reading unit configured to read an original;

a first original placing portion on which the original is placed so that the reading unit reads the original;

an original pressure cover configured to be opened and closed with respect to the first original placing portion; and a second original placing portion on which the original to be conveyed to a reading position in which the reading unit reads the original is placed, wherein, when the original pressure cover is operated in a state in which the rotary polygon mirror is stopped or when the original is placed on the second original placing portion in a state in which the rotary polygon mirror is stopped, the control unit starts to rotate the rotary polygon mirror.

5. An image forming apparatus according to claim 1, further comprising an operating portion, the operating portion comprising:

a setting button configured to set image formation conditions; and an instruction button configured to instruct the start of the image formation, wherein, when at least one of the setting button and the instruction button is pressed down in a state in which the rotary polygon mirror is stopped, the control unit starts to rotate the rotary polygon mirror.

6. An image forming apparatus according to claim 1, further comprising a display portion configured to set image formation conditions, wherein, when a process on the display portion is performed in a state in which the rotary polygon mirror is stopped, the control unit starts to rotate the rotary polygon mirror.

7. An image forming apparatus according to claim 1, wherein the temperature detecting unit detects a temperature of the motor or an ambient temperature of the motor.

8. An image forming apparatus according to claim 1, further comprising a lapsed time obtaining unit configured to obtain a lapsed time from when a previous image formation is completed until a current rotation of the motor is started, wherein, when the lapsed time obtained by the lapsed time obtaining unit is a first time period, the control unit sets the target value to a first rotation speed, and, when the lapsed time obtained by the lapsed time obtaining unit is a second time period which is shorter than the first time period, the control unit sets the target value to a second rotation speed which is lower than the first rotation speed.

9. An image forming apparatus according to claim 1, further comprising a total operation time obtaining unit configured to obtain a total operation time of the motor, wherein, when the total operation time obtained by the total operation time obtaining unit is a first time period, the control unit sets the target value to a first rotation speed, and, when the total operation time obtained by the total operation time obtaining unit is a second time period which is shorter than the first time period, the control unit sets the target value to a second rotation speed which is lower than the first rotation speed.

10. An image forming apparatus according to claim 1, the temperature detecting unit is provided in the housing.

11. An image forming apparatus, comprising:

a photosensitive member;

a light source configured to emit a light beam based on image data to form an electrostatic latent image on the photosensitive member;

a deflecting unit configured to deflect the light beam so that the light beam scans the photosensitive member, the deflecting unit comprising a rotary polygon mirror and a motor configured to rotate the rotary polygon mirror;

an estimating unit configured to estimate a rise time of the motor; and a control unit configured to pre-rotate the rotary polygon mirror before a start signal for instructing a start of image formation is generated, and configured to rotate, after the start signal is generated, the rotary polygon mirror at a rotation speed which is higher than a rotation speed for pre-rotation of the rotary polygon mirror, wherein the control unit sets a target value of the rotation speed for the pre-rotation of the rotary polygon mirror based on a result of estimation by the estimating unit.

12. An image forming apparatus according to claim 11, wherein the estimating unit comprises a temperature detecting unit configured to detect an ambient temperature of the motor, and wherein the control unit sets the target value based on a result of detection by the temperature detecting unit.

13. An image forming apparatus according to claim 11, wherein the estimating unit comprises a lapsed time obtaining unit configured to obtain a lapsed time from when a previous image formation is completed until a current rotation of the motor is started, and wherein, when the lapsed time obtained by the lapsed time obtaining unit is a first time period, the control unit sets the target value to a first rotation speed, and, when the lapsed time obtained by the lapsed time obtaining unit is a second time period which is shorter than the first time period, the control unit sets the target value to a second rotation speed which is lower than the first rotation speed.

14. An image forming apparatus according to claim 11, wherein the estimating unit comprises a total operation time obtaining unit configured to obtain a total operation time of the motor, and wherein, when the total operation time obtained by the total operation time obtaining unit is a first time period, the control unit sets the target value to a first rotation speed, and, when the total operation time obtained by the total operation time obtaining unit is a second time period which is shorter than the first time period, the control unit sets the target value to a second rotation speed which is lower than the first rotation speed.

* * * * *